US009767736B2

(12) United States Patent
Lee et al.

(10) Patent No.: US 9,767,736 B2
(45) Date of Patent: Sep. 19, 2017

(54) BACKLIGHT UNIT AND DISPLAY APPARATUS INCLUDING THE SAME

(71) Applicant: SAMSUNG DISPLAY CO., LTD., Yongin-Si, Gyeonggi-Do (KR)

(72) Inventors: Sanghyun Lee, Incheon (KR); Geunhyuk Choi, Suncheon-si (KR); Hyejung Hong, Cheonan-si (KR)

(73) Assignee: Samsung Display Co., LTD. (KR)

( * ) Notice: Subject to any disclaimer, the term of this patent is extended or adjusted under 35 U.S.C. 154(b) by 0 days.

(21) Appl. No.: 14/968,454

(22) Filed: Dec. 14, 2015

(65) Prior Publication Data

US 2016/0210909 A1 Jul. 21, 2016

(30) Foreign Application Priority Data

Jan. 16, 2015 (KR) ..... 10-2015-0008246

(51) Int. Cl.
*G09G 3/36* (2006.01)
*G09G 3/34* (2006.01)
*H05B 33/08* (2006.01)

(52) U.S. Cl.
CPC ..... *G09G 3/3406* (2013.01); *G09G 3/3648* (2013.01); *H05B 33/086* (2013.01); *G09G 2320/062* (2013.01); *G09G 2320/064* (2013.01)

(58) Field of Classification Search
CPC ..... G09G 3/34–3/3406
USPC ..... 345/102
See application file for complete search history.

(56) References Cited

U.S. PATENT DOCUMENTS

2005/0012468 A1* 1/2005 Ryu ..... H05B 41/392 315/274
2007/0211014 A1* 9/2007 Kim ..... G09G 3/3406 345/102
2015/0116382 A1* 4/2015 Im ..... G09G 3/3406 345/691
2015/0130371 A1 5/2015 Lee et al.

FOREIGN PATENT DOCUMENTS

KR 10-2009-0066546 A 6/2009
KR 10-2009-0109435 A 10/2009
KR 10-2012-0112950 A 10/2012
KR 10-2012-0133814 A 12/2012
(Continued)

OTHER PUBLICATIONS

J. Garcia et al., "Low Ripple Interleaved Converter for Fast PWM Dimming of Power LEDs," IEEE International Symposium on Industrial Electronics, Jul. 2010, pp. 915-920, 2163-5137, IEEE.

*Primary Examiner* — Roy Rabindranath
(74) *Attorney, Agent, or Firm* — Innovation Counsel LLP

(57) ABSTRACT

A backlight unit of a display apparatus includes a power converter generating a light source power voltage in response to a power control signal, a first node, a second node, a light emitting element connected between the first node and the second node, and a controller connected to the second node. The light emitting element is configured to receive the light source power voltage through the first node, and the controller is configured to output the power control signal for controlling current flowing through the light emitting element in response to a dimming signal. When the dimming signal has a first level, the controller outputs the power control signal to turn off the power converter.

13 Claims, 3 Drawing Sheets

(56) References Cited

FOREIGN PATENT DOCUMENTS

| | | | |
|---|---|---|---|
| KR | 10-2013-0015852 | A | 2/2013 |
| KR | 10-2013-0021909 | A | 3/2013 |
| KR | 10-2013-0027094 | A | 3/2013 |
| KR | 10-2013-0124096 | A | 11/2013 |
| KR | 10-1352123 | B1 | 1/2014 |
| KR | 10-1357006 | B1 | 1/2014 |

* cited by examiner

BACKLIGHT UNIT AND DISPLAY APPARATUS INCLUDING THE SAME

CROSS-REFERENCE TO RELATED APPLICATIONS

This application claims priority to Korean Patent Application No. 10-2015-0008246 filed on Jan. 16, 2015, and the benefits accruing therefrom under 35 U.S.C. §119, the disclosure of which is hereby incorporated by reference in its entirety.

BACKGROUND

The present disclosure relates to a backlight unit and a display apparatus including the same. A display device provides images and a graphical user interface to an electronic device. A flat panel display device is widely used as a display device thanks to its low power consumption, light weight, and compact size.

A liquid crystal display (LCD) device is currently the most popular flat panel display device. The LCD is a light receiving device that adjusts an amount of light incident from a light source to display an image. A backlight unit (BLU) includes the light source for irradiating light onto a liquid crystal panel of the LCD device.

In recent years, a light emitting diode (LED) having advantages of low power, bio-friendly, and slim-type design has been widely used as a light source. However, an optical design of the LED is difficult for maintaining brightness and color uniformity over the whole display area of the display device, and it is required to momentarily control current of the LED to combine colors.

A dimming method may be used to adjust a power on/off time to the backlight unit, thereby adjusting the brightness of the backlight unit. However, a ripple effect may occur in the supply voltage to the backlight unit when turning on/off the backlight. When the ripple effect occurs, the brightness of an image displayed on the display panel may be non-uniform.

SUMMARY

The present disclosure provides a backlight unit capable of supplying a stable voltage to a light emitting diode. The present disclosure also provides a display apparatus including a backlight unit capable of providing a stable voltage to a light emitting diode.

Embodiments of the present disclosure provide backlight units including: a power converter generating a light source power voltage in response to a power control signal; a first node; a second node; a light emitting element connected between the first node and the second node, and a controller connected to the second node. The light emitting element is configured to receive the light source power voltage through the first node. The controller is configured to output the power control signal for controlling current flowing through the light emitting element in response to a dimming signal. When the dimming signal has a first level, the controller outputs the power control signal to turn off the power converter.

In exemplary embodiments, the controller may include: a first transistor connected between the second node and a third node and comprising a gate terminal connected to the dimming signal; a ripple prevention part supplying a second reference current to the third node in response to the dimming signal; a comparator including a reverse input terminal connected to the third node and a non-reverse input terminal connected to a first reference current and configured to output a comparison signal; and a control unit configured to output the power control signal in response to the comparison signal.

In exemplary embodiments, the ripple prevention part may include: an inverter receiving the dimming signal; and a second transistor connected between a second reference current and the third node and configured to transmit the second reference current to the third node in response to an output signal of the inverter.

In exemplary embodiments, the control unit may output the power control signal having a first level so that the power converter is turned off when the comparison signal has the first level and outputs the power control signal having the second level so that the power converter is turned on when the comparison signal has the second level.

In exemplary embodiments, the second reference current may have a level higher than that of the first reference current.

In exemplary embodiments of the present disclosure, display apparatuses include: a display panel including a plurality of pixels; a driving circuit configured to display an image on the display panel, and output a dimming signal; and a backlight unit providing light to the display panel, wherein the backlight unit includes: a power converter generating a light source power voltage in response to a power control signal; a first node; a second node; a light emitting element connected between the first node and the second node, and a controller connected to the second node. The light emitting element is configured to receive the light source power voltage through the first node. The controller is configured to output the power control signal for controlling current flowing through the light emitting element in response to a dimming signal. When the dimming signal has a first level, the controller outputs the power control signal to turn off the power converter.

In exemplary embodiments, the controller may include: a first transistor connected between the second node N2 and a third node N3 and comprising a gate terminal connected to the dimming signal; a ripple prevention part supplying second reference current to the third node in response to the dimming signal; a comparator comprising a reverse input terminal connected to the third node and a non-reverse input terminal connected to a first reference current and configured to output a comparison signal; and a control unit configured to output the power control signal in response to the comparison signal.

In exemplary embodiments, the ripple prevention part may include: an inverter receiving the dimming signal; and a second transistor connected between a second reference current and the third node to transmit the second reference current to the third node in response to an output signal of the inverter.

In exemplary embodiments, the control unit may output the power control signal having a first level so that the power converter is turned off when the comparison signal has the first level and outputs the power control signal having the second level so that the power converter is turned on when the comparison signal has the second level.

In exemplary embodiments, the second reference current may have a level higher than that of the first reference current.

In exemplary embodiments, the driving circuit may include: a gate driver configured to drive a plurality of gate lines respectively connected to the plurality of pixels; a data driver configured to drive the plurality of data lines respectively connected to the plurality of pixels; and a timing controller configured to control the gate driver and the data driver, and the timing controller outputting the dimming signal.

BRIEF DESCRIPTION OF THE DRAWINGS

The accompanying drawings are included to provide a further understanding of the present disclosure, and are incorporated in and constitute a part of this specification. The drawings illustrate exemplary embodiments of the present disclosure and, together with the detailed description, serve to explain principles of the present disclosure. In the drawings.

DETAILED DESCRIPTION

Figure 1:
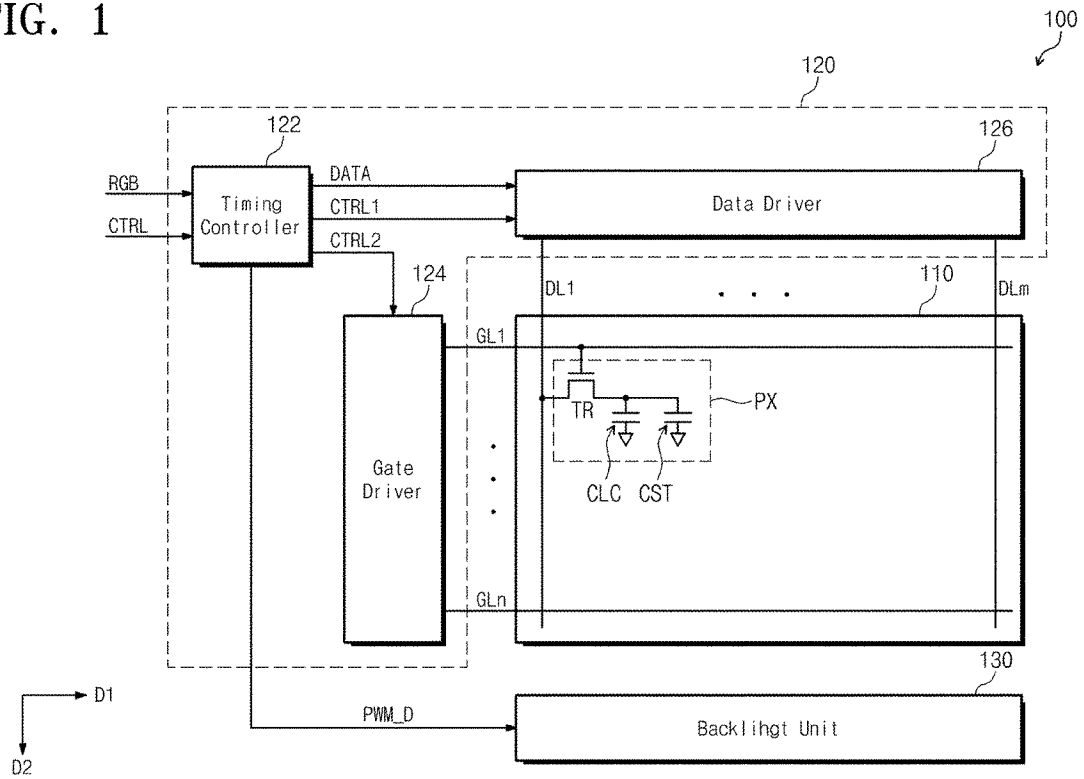
FIG. 1 is a block diagram illustrating an exemplary embodiment of a configuration of a display apparatus, according to an embodiment of the present disclosure.

Hereinafter, various embodiments of the present disclosure will be described below in more detail with reference to the accompanying drawings. FIG. 1 is a block diagram of a display apparatus, according to an embodiment of the present disclosure. A display apparatus 100 includes a display panel 110, a driving circuit 120, and a backlight unit 130. The display panel 110 displays an image. In this embodiment, a liquid crystal display panel will be described as an example of the display panel 110, but the present disclosure is not limited thereto. For example, different kinds of display panels that need a backlight unit 130 may be applied.

The display panel 110 includes a plurality of gate lines GL1 to GLn extending in a first direction D1, a plurality of data lines DL1 to DLm extending in a second direction D2, and a plurality of pixels PX arranged on an each intersection area of the gate lines GL1 to GLn and data lines DL1 to DLm. The plurality of data lines DL1 to DLm and the plurality of gate lines GL1 to GLn are insulated from each other at the intersection areas. Each of the pixels PX includes a thin film transistor TR, a liquid crystal capacitor CLC, and a storage capacitor CST.

The pixels PX have the same structure. Accordingly, in a description the pixels PX, only one pixel may be described as an example. For example, the thin film transistor TR of the first pixel PX includes a gate electrode connected to a first gate line GL1 of the plurality of gate lines GL1 to GLn, a source electrode connected to a first data line DL1 of the plurality of data lines DL1 to DLm, and a drain electrode connected to the liquid crystal capacitor CLC and the storage capacitor CST. One end of each of the liquid crystal capacitor CLC and the storage capacitor CST is connected to the drain electrode of the thin film transistor TR in parallel. The other end of each of the liquid crystal capacitor CLC and the storage capacitor CST may be connected to a common voltage.

The driving circuit 120 includes a timing controller 122, a gate driver 124, and a data driver 126. The timing controller 122 receives an image signal RGB and a control signal CTRL from an external source, for example, a graphics card. For example, the control signals include a vertical synchronization signal, a horizontal synchronization signal, a main clock signal, a data enable signal, and the like. The timing controller 122 provides a data signal DATA and a first control signal CTRL 1 to the data driver 126. The data signal DATA is generated by processing an image signal RGB to match an operation condition of the display panel 110 on the basis of the control signals CTRL. The timing controller 122 also provides a second control signal CTRL2 to the gate driver 124. The first control signal CTRL1 may include a horizontal synchronization start signal, a clock signal, and a line latch signal. The second control signal CTRL2 may include a vertical synchronization start signal, an output enable signal, and a gate pulse signal. The timing controller 122 may variously change the data signal DATA according to an arrangement of the pixels PX of the display panel 110, a display frequency, and the like, to output the changed data signal DATA. The timing controller 122 provides a dimming signal PWM_D for controlling the backlight unit 130 to the backlight unit 130.

The gate driver 124 drives the gate lines GL1 to GLn in response to the second control signal CTRL2 that is received from the timing controller 122. The gate driver 124 may include a gate driving integrated circuit (IC). The gate driver 124 may be realized as a circuit using an oxide semiconductor, an amorphous semiconductor, a polycrystalline semiconductor, or the like. The data driver 126 drives the data lines DL1 to DLm in response to the data signal DATA and the first control signal CTRL1 received from the timing controller 122.

According to one embodiment, the backlight unit 130 is disposed below the display panel 110 to face the pixels PX. The backlight unit 130 operates in response to the dimming signal PWM_D received from the timing controller 122. Detailed description and operational principles of the backlight unit 130 will be explained with reference to FIG. 2.

Figure 2:
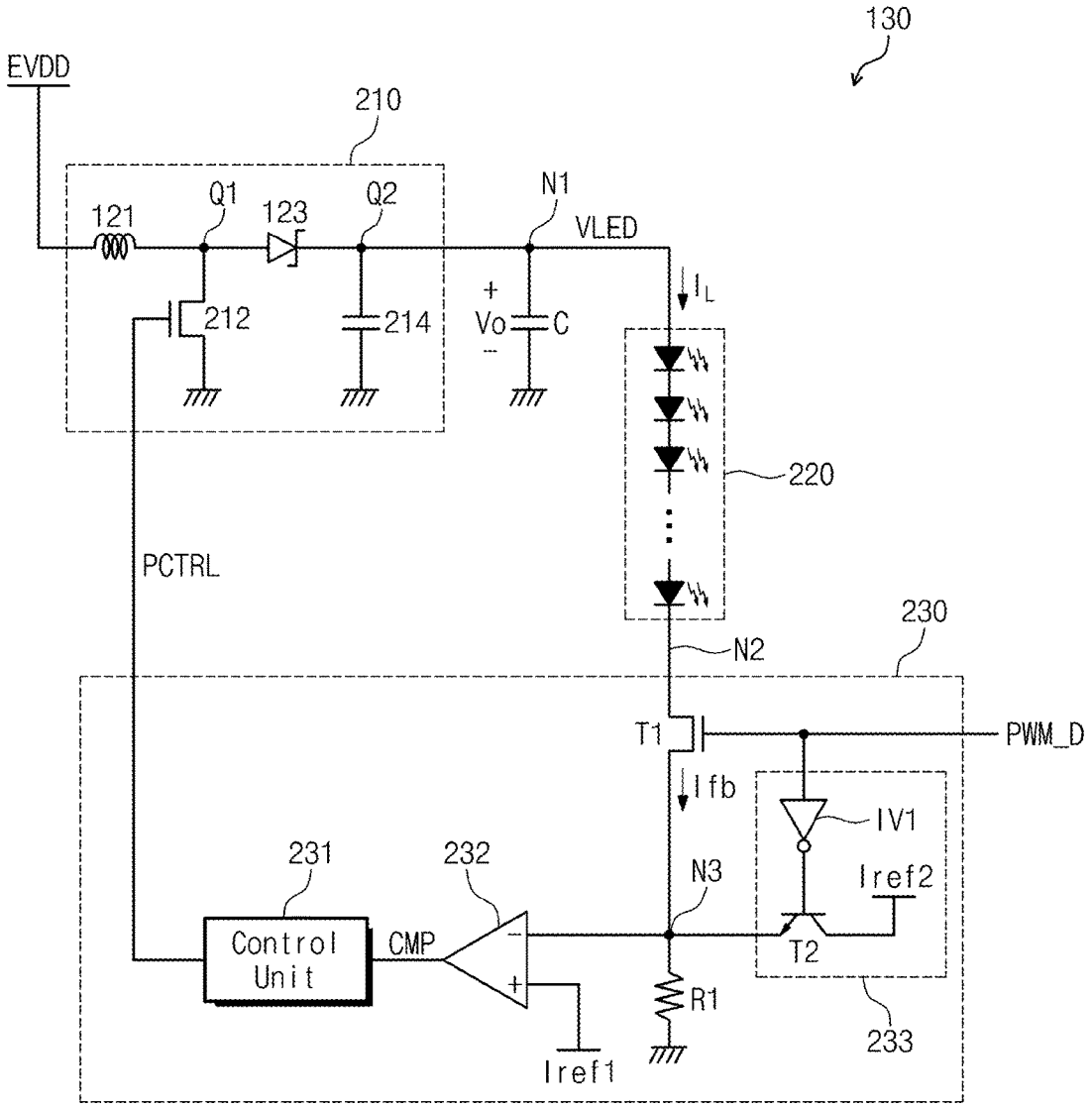
FIG. 2 is a view illustrating one example of a backlight unit illustrated in FIG. 1.

FIG. 2 is a view illustrating one example of a backlight unit illustrated in FIG. 1. The backlight unit 130 includes a power converter 210, a light source 220, a controller 230, and an output capacitor C connected between the power converter 210 and the controller 230. The power converter 210 converts a power voltage EVDD received from the outside into a light source power voltage VLED. The light source power voltage VLED has to be set to a voltage level that is enough to drive light emitting diodes contained in the light source 220.

The power converter 210 includes an inductor 121, an NMOS transistor 212, a diode 123, and a capacitor 214. The inductor 121 is connected between the power voltage EVDD and a node Q1. The NMOS transistor 212 is connected between the node Q1 and a ground voltage. The NMOS transistor 212 has a gate connected to a power control signal PCTRL of the controller 230. The diode 123 is connected between the node Q1 and a node Q2. In one embodiment, the diode 123 may be a Schottky diode. The capacitor 214 is connected between the node Q2 and the ground voltage. The light source power voltage VLED of the node Q2 is supplied to one end of the light source 220 through a first node N1.

The power converter 210 may be one of various types of DC/DC converters such as a buck-boost type, a boost type, and a high-bridge type. The power converter 210 illustrated in FIG. 2 converts the power voltage EVDD into the light source power voltage VLED. The NMOS transistor 212 may be turned on/off according to the power control signal PCTRL that is connected to the gate of the NMOS transistor 212 to adjust a voltage level of the light source power voltage VLED.

According to one embodiment, the light source 220 includes a light emitting diode (LED) string. Although FIG.

2 illustrates the light source 220 including one light emitting diode string, the present disclosure is not limited thereto. It is understood that the number of the light emitting diode strings included in the light source 220 may vary and a different type of light emitting devices/elements (e.g., a laser diode and a carbon nanotube) may be used without deviating from the scope of the present disclosure.

The light emitting diode string included in the light source 220 includes a plurality of emitting diodes that are connected to each other in series. Each of the plurality of light emitting diodes may include a white light emitting diode that emits white light, a red white light emitting diode that emits red light, a blue white light emitting diode that emits blue light, and a green white light emitting diode that emits green light. The light emitting diodes may be driven at a general low forward driving voltage $V_f$ are to reduce power consumption. A less fluctuation in the forward driving voltage $V_f$ of the light emitting diodes can achieve uniformity in brightness. The light source 220 has one end connected to the light source power voltage VLED outputted from the power converter 210 through the first node N1. The second node N2 that is the other end of the light source 220 is connected to the controller 230.

The controller 230 includes a control unit 231, a comparator 232, a ripple prevention part 233, a resistor R1, and a first transistor T1. The first transistor T1 is connected between the second node N2 and the third node N3 and includes a gate terminal that is controlled by the dimming signal PWM_D. The dimming signal PWM_D may be a signal received from the timing controller 122 of FIG. 1. In another example, the controller 230 may further include a circuit processing the dimming signal PWM_D received from the timing controller 122 of FIG and transmit the processed dimming signal to the gate terminal of the first transistor T1. According to one embodiment, the first transistor T1 includes a metal oxide semiconductor (MOS).

The ripple prevention part 233 includes an inverter IV1 and a second transistor T2. The inverter IV1 receives the dimming signal PWM_D. The second transistor T2 is connected between a second reference current Iref2 and the third node N3 and includes a gate terminal connected to an output signal outputted from the inverter IV1. The second transistor T2 may be a bipolar transistor. The resistor R1 is connected between the third node N3 and the ground voltage.

The comparator 232 includes a reverse input terminal (−) connected to the third node N3 and a non-reverse input terminal (+) connected to a first reference current Iref1 to output a comparison signal CMP. The comparator 232 compares current inputted through the reverse input terminal (−) with the first reference current Iref1 inputted through the non-reverse input terminal (+) to output the comparison signal CMP according to the compared result.

The control unit 231 outputs the power control signal PCTRL in response to the comparison signal CMP received from the comparator 232. For example, when the comparison signal CMP has a low level, the control unit 231 outputs a power control signal PCTRL having a low level. On the other hand, when the comparison signal CMP has at a high level, the control unit 231 outputs a power control signal PCTRL having a high level.

Figure 3:
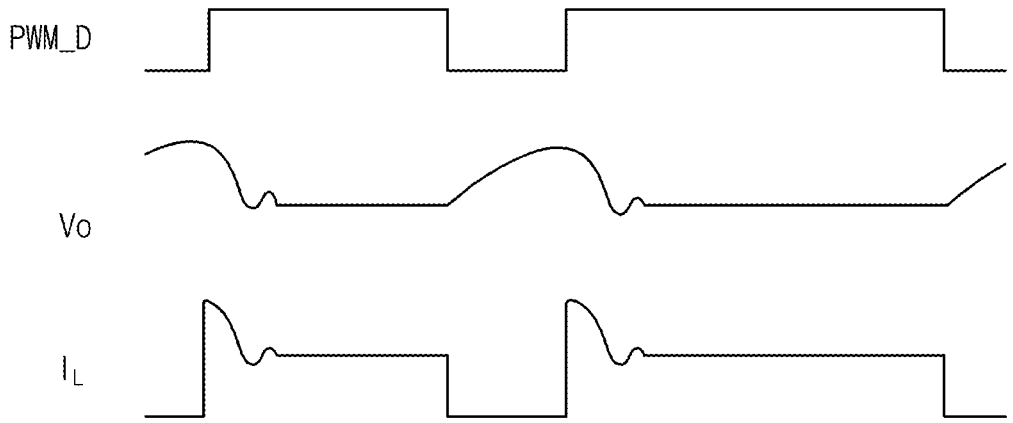
FIG. 3 is a timing diagram illustrating an operation example of a power converter in the backlight unit of FIG. 2.

FIG. 3 is a timing diagram illustrating an operational example of a power converter in the backlight unit of FIG. 2. The timing diagram illustrated in FIG. 3 illustrates a comparative example when the ripple prevention part 233 of FIG. 2 does not exist or operate.

Referring to FIGS. 2 and 3, when the dimming signal PWM_D is transited from the low level to the high level, the first transistor T1 is turned on. When the first transistor T1 is turned on, current flows through the light source 220. The power converter 210 does not operate while the dimming signal PWM_D has the low level and rapidly increases an output voltage $V_o$ at both ends of the output capacitor C. When the dimming signal PWM_D changes from the high level to the low level, the light source 220 does not operate because the first transistor T1 is turned off. Accordingly, current IL does not flow through the light source 220, and an output terminal of the power converter 210 is in a no-load state to increase the output voltage $V_o$.

As described above, since the first transistor T1 is repeatedly turned on/off in response to the dimming signal PWM_D, the output voltage $V_o$ of the power converter 210 repeatedly increase and decrease. This requires high pressure resistance characteristics of the output capacitor C. When a duty cycle of the dimming signal PWM_D is shorter, an output voltage $V_o$ further decreases, thus the ripple effect of the output voltage increases. Thus, it may be difficult to realize a precise resolution. Since the ripple of the output voltage $V_o$ affects the light source power voltage VLED supplied to the light source, the brightness may vary.

Figure 4:
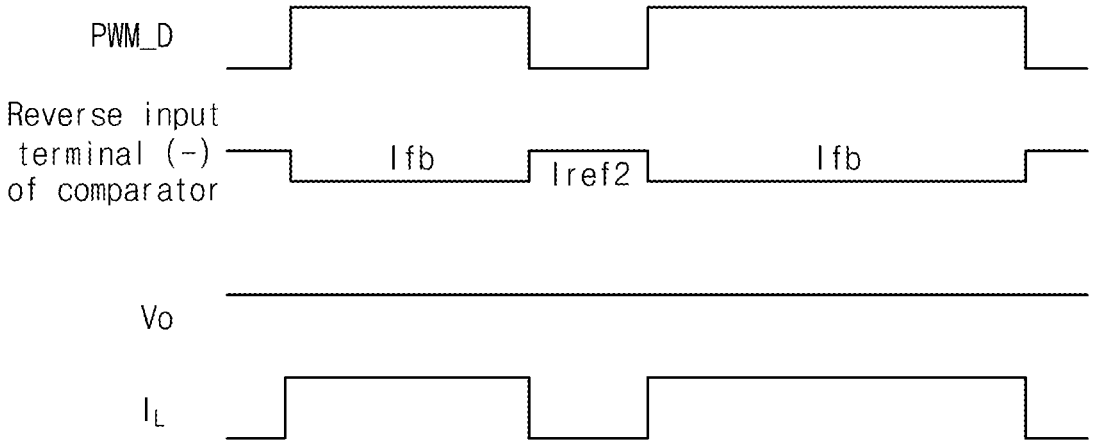
FIG. 4 is a timing diagram for explaining an operation of the backlight unit of FIG. 2.

FIG. 4 is a timing diagram for explaining an operation of the backlight unit of FIG. 2 with an operational ripple prevention part 233. Referring to FIGS. 2 and 4, when the dimming signal PWM_D has the high level, the first transistor T1 is turned on. Accordingly, the feedback current Ifb received from the light source 220 is provided to the reverse input terminal (−) of the comparator 232 through the first transistor T1. The comparator 232 compares the feedback current Ifb on the reverse input terminal (−) with the first reference current Iref1 to output the comparison signal CMP. The controller 230 may control and turn on/off the transistor 212 of the power converter 210 according to the comparison signal CMP. By controlling the transistor 212, the controller 230 can provide a uniform current flow to the light source 220.

When the dimming signal PWM_D is transited from the high level to the low level, the first transistor T1 is turned off, and the inverter IV1 in the ripple prevention part 233 outputs the high level signal. The second transistor T2 transmits the second reference current Iref2 to the third node N3 in response to the high level signal of the dimming signal PWM_D.

According to one embodiment, the second reference current Iref2 may have a current level higher than that of the first reference current Iref1. The comparator 232 compares the second reference current Iref2 of the third node N3 at the reverse input terminal (−), with the first reference current Iref1 at the non-reverse input terminal (+). Since the second reference current Iref2 has a current level higher than that of the first reference current Iref1, the comparison signal CMP has a low level. The control unit 231 outputs the power control signal PCTRL having a low level in response to the comparison signal CMP having the low level. Accordingly, the transistor 212 in the power converter 212 is turned off in response to the power control signal PCTRL having the low level.

Since the first transistor is turned off when the dimming signal PWM_D is transited from the high level to the low level, no current flows into the light source 220. When the transistor 212 is turned off, the output voltage $V_o$ is maintained to a certain level by the capacitor C. Therefore, the ripple effect that may occur in the output voltage $V_o$ may be remarkably reduced.

The backlight unit disclosed in the present disclosure suppresses and minimizes a ripple phenomenon caused by a fluctuating power signal provided to the light emitting diode. Therefore, the quality of the image displayed on the display device may be improved.

The scope of the present disclosure is not limited to the embodiments described above. It is evident, however, that many alternative modifications and variations will be apparent to those having skill in the art in light of the foregoing description. Therefore, the present disclosure embraces such alternative modifications and variations as falling within the spirit and scope of the present disclosure.

What is claimed is:

1. A backlight unit comprising:

a power converter configured to generate a light source power voltage in response to a power control signal;

a first node;

a second node;

a light emitting element connected between the first node and the second node; and a controller connected to the second node, comprising a third node and configured to receive a dimming signal, wherein the light emitting element is configured to receive the light source power voltage through the first node, wherein the controller comprises:

a first transistor connected between the second node and the third node and comprising a gate terminal connected to the dimming signal; and a ripple prevention part supplying a second reference current to the third node when the dimming signal has a first level, and wherein the controller is configured to output the power control signal for controlling current flowing through the light emitting element based on a signal of the third node.

2. The backlight unit of claim 1, wherein the controller further comprises:

a comparator comprising a reverse input terminal connected to the third node and a non-reverse input terminal connected to a first reference current and configured to output a comparison signal; and a control unit configured to output the power control signal in response to the comparison signal.

3. The backlight unit of claim 2, wherein the control unit outputs the power control signal having a first level so that the power converter is turned off when the comparison signal has the first level and outputs the power control signal having the second level so that the power converter is turned on when the comparison signal has the second level.

4. The backlight unit of claim 2, wherein the second reference current has a level higher than that of the first reference current.

5. The backlight unit of claim 1, wherein the ripple prevention part comprises:

an inverter receiving the dimming signal; and a second transistor connected between the second reference current and the third node and configured to transmit the second reference current to the third node in response to an output signal of the inverter.

6. The backlight unit of claim 1, wherein the controller outputs the power control signal to turn off the power converter when the dimming signal has the first level.

7. A display apparatus comprising:

a display panel comprising a plurality of pixels;

a driving circuit configured to display an image on the display panel and output a dimming signal; and a backlight unit providing light to the display panel, wherein the backlight unit comprises:

a power converter configured to generate a light source power voltage in response to a power control signal;

a first node;

a second node;

a light emitting element connected between the first node and the second node; and a controller connected to the second node, comprising a third node and configured to receive a dimming signal, wherein the at light emitting element is configured to receive the light source power voltage through the first node, and wherein the controller comprises:

a first transistor connected between the second node and the third node and comprising a gate terminal connected to the dimming signal; and a ripple prevention part supplying a second reference current to the third node when the dimming signal has a first level, and wherein the controller is configured to output the power control signal for controlling current flowing through the light emitting element based on a signal of the third node.

8. The display apparatus of claim 7, wherein the controller further comprises:

a comparator comprising a reverse input terminal connected to the third node and a non-reverse input terminal connected to a first reference current and configured to output a comparison signal; and a control unit configured to output the power control signal in response to the comparison signal.

9. The display apparatus of claim 8, wherein the control unit outputs the power control signal having a first level so that the power converter is turned off when the comparison signal has the first level and outputs the power control signal having the second level so that the power converter is turned on when the comparison signal has the second level.

10. The display apparatus of claim 8, wherein the second reference current has a level higher than that of the first reference current.

11. The display apparatus of claim 7, wherein the ripple prevention part comprises:

an inverter receiving the dimming signal; and a second transistor connected between the second reference current and the third node and configured to transmit the second reference current to the third node in response to an output signal of the inverter.

12. The display apparatus of claim 7, wherein the driving circuit comprises:

a gate driver configured to drive a plurality of gate lines respectively connected to the plurality of pixels;

a data driver configured to drive the plurality of data lines respectively connected to the plurality of pixels; and a timing controller configured to control the gate driver and the data driver and output the dimming signal.

13. The display apparatus of claim 7, wherein the controller outputs the power control signal to turn off the power converter when the dimming signal has the first level.

* * * * *